US009081317B2

(12) United States Patent
Sugawara et al.

(10) Patent No.: US 9,081,317 B2
(45) Date of Patent: Jul. 14, 2015

(54) POSITIVELY CHARGEABLE TONER, ELECTROSTATIC CHARGE IMAGE DEVELOPER, TONER CARTRIDGE, IMAGE FORMING METHOD, AND IMAGE FORMING APPARATUS

(71) Applicant: FUJI XEROX CO., LTD., Tokyo (JP)

(72) Inventors: Atsushi Sugawara, Kanagawa (JP); Masanobu Ninomiya, Kanagawa (JP); Noriyuki Mizutani, Kanagawa (JP); Akira Matsumoto, Kanagawa (JP); Yusuke Ikeda, Kanagawa (JP); Satoshi Kamiwaki, Kanagawa (JP); Yukiaki Nakamura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 13/870,516

(22) Filed: Apr. 25, 2013

(65) Prior Publication Data

US 2014/0106273 A1 Apr. 17, 2014

(30) Foreign Application Priority Data

Oct. 16, 2012 (JP) ..... 2012-228822

(51) Int. Cl.

| | |
|---|---|
| ***G03G 9/087*** | (2006.01) |
| ***G03G 13/22*** | (2006.01) |
| ***G03G 15/08*** | (2006.01) |
| ***G03G 9/08*** | (2006.01) |

(52) U.S. Cl.

CPC ..... *G03G 9/08791* (2013.01); *G03G 9/0823* (2013.01); *G03G 9/08795* (2013.01); *G03G 13/22* (2013.01); *G03G 15/08* (2013.01)

(58) Field of Classification Search

CPC ..... G03G 9/08795; G03G 9/08797; G03G 13/013

USPC ..... 430/108.2, 123.41; 399/222

See application file for complete search history.

(56) References Cited

U.S. PATENT DOCUMENTS

| | | | | |
|---|---|---|---|---|
| 4,476,212 | A * | 10/1984 | Kakimi | 430/137.11 |
| 4,933,252 | A * | 6/1990 | Nishikawa et al. | 430/108.2 |
| 5,147,750 | A * | 9/1992 | Nakanishi | 430/108.22 |
| 6,235,441 | B1 | 5/2001 | Tanikawa et al. | |
| 2008/0182198 | A1 | 7/2008 | Kawamura et al. | |
| 2009/0246669 | A1 | 10/2009 | Uno | |
| 2010/0196817 | A1* | 8/2010 | Sasaki et al. | 430/109.4 |
| 2011/0086301 | A1* | 4/2011 | Cheng et al. | 430/105 |

FOREIGN PATENT DOCUMENTS

| | | |
|---|---|---|
| JP | A-49-91231 | 8/1974 |
| JP | A-56-40868 | 4/1981 |
| JP | A-2000-235279 | 8/2000 |
| JP | A-2002-139868 | 5/2002 |
| JP | A-2004-86000 | 3/2004 |
| JP | A-2008-186002 | 8/2008 |
| JP | A-2008-203736 | 9/2008 |
| JP | A-2008-209489 | 9/2008 |
| JP | A-2009-244494 | 10/2009 |

OTHER PUBLICATIONS

Diamond, "The Handbook of Imaging Materials," Marcel Dekker, NY, NY 1991.*

EPOMIN Property Sheet obtained from http://www.farbeundlack.de/img/navigator/lack/NipponShokubai_MM_DOC_Epomin.pdf, published Apr. 2005.*

* cited by examiner

*Primary Examiner* — Peter Vajda

(74) *Attorney, Agent, or Firm* — Oliff PLC

(57) ABSTRACT

There is provided a positively chargeable toner including toner mother particles containing a binder resin having an ethylenically unsaturated bond, wherein the amine value of a component extracted with a water phase by the addition of ion exchanged water after mixing the toner with methyl ethyl ketone is from 600 to 1,250 and the weight average molecular weight of the component extracted with the water phase is from 1,000 to 200,000.

15 Claims, No Drawings

POSITIVELY CHARGEABLE TONER, ELECTROSTATIC CHARGE IMAGE DEVELOPER, TONER CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2012-228822 filed Oct. 16, 2012.

BACKGROUND

1. Technical Field

The present invention relates to a positively chargeable toner, an electrostatic charge image developer, a toner cartridge, an image forming method, and an image forming apparatus.

2. Related Art

A method for visualizing image information via an electrostatic latent image using electrophotography or the like is currently used in a variety of fields. In electrophotography, an electrostatic latent image is formed on a photoreceptor by a charging step and an exposure step, the electrostatic latent image is visualized by the steps of developing by a developer including a toner, and transferring and fixing the image.

Dry type developers may be usually classified into a single-component developer using a toner having colorants dispersed in a binder resin as it is, and a two-component developer having a carrier mixed with the toner, further, examples of the single-component developer include a magnetic single-component toner using a magnetic toner and a non-magnetic single-component toner using a non-magnetic toner.

SUMMARY

According to an aspect of the invention, there is provided a positively chargeable toner including toner mother particles containing a binder resin having an ethylenically unsaturated bond, wherein a component extracted with a water phase by the addition of ion exchanged water after mixing the toner with methyl ethyl ketone has an amine value of from 600 to 1,250 and a weight average molecular weight of from 1,000 to 200,000.

DETAILED DESCRIPTION

Hereinbelow, the present exemplary embodiments will be described in detail.

Furthermore, in the present exemplary embodiment, a phrase "A to B" denotes a range of A to B as well as a range including the limits A and B. For example, if "A to B" indicates a numerical range, it represents "from A to B" or "from B to A" according to the size order of the numerical values.

Positively Chargeable Toner

The positively chargeable toner of the present exemplary embodiment (hereinafter also simply referred to as a "toner") includes toner mother particles containing at least a binder resin having an ethylenically unsaturated bond, wherein the amine value of the component extracted with a water phase by the addition of ion exchanged water after mixing the toner with methyl ethyl ketone is from 600 to 1,250 and the weight average molecular weight of the component extracted with the water phase is from 1,000 to 200,000.

For the toner of the present exemplary embodiment, the amine value of the component extracted with a water phase by the addition of ion exchanged water after mixing the toner with methyl ethyl ketone is from 600 to 1,250 and the weight average molecular weight of the component extracted with the water phase is from 1,000 to 200,000.

In the present exemplary embodiment, the extraction with a water phase carried out by the addition of ion exchanged water after mixing the toner with methyl ethyl ketone is carried out by the following method.

To a beaker are added 5 g of a toner and 100 g of methyl ethyl ketone (MEK), followed by stirring at room temperature (25° C.) for 1 hour, and the components other than the insoluble components in the toner, such as external additives and pigments, are dissolved in MEK. Subsequently, to the beaker is added 100 g of ion exchanged water, followed by stirring for 1 hour and then being left to stand for 1 hour. The precipitates are removed and the water phase portion is separated from the MEK phase to obtain an aqueous solution of the extract. The obtained aqueous solution may be dried in a vacuum dryer to obtain an extract.

Furthermore, the method for measuring the amine value of the extract in the present exemplary embodiment is carried out by the following method.

About 0.5 g of the extract obtained above is precisely weighed into a 100-ml Erlenmeyer flask, in which 25 ml of methanol has been added, 2 to 3 droplets of an indicator (a solution formed by mixing a solution having 0.20 g of methanol orange dissolved in 50 mL of ion exchanged water and a solution having 0.28 g of xylene cyanol dissolved in 50 ml of methanol) are added thereto, followed by titration with an N/2 hydrochloric acid-ethanol solution until the green color changes into the blue-gray color. At this time, the amine value is calculated by a formula (1), taking the amount of the N/2 hydrochloric acid-ethanol solution used for the titration as B g. In the formula (1), w is the amount (g) of a sample precisely weighed and f is a factor of the N/2 hydrochloric acid-ethanol solution.

$$\text{Amine value}=(B\times\tfrac{1}{2}\times f\times 56.11)/w \qquad \text{Formula (1)}$$

For the toner of the present exemplary embodiment, the amine value of the component extracted with a water phase by the addition of ion exchanged water after mixing the toner with methyl ethyl ketone is preferably from 800 to 1,200, more preferably from 850 to 1,150, and even more preferably from 950 to 1,100. Within the above ranges, the positive charging amount is sufficiently obtained, and in addition, generation of fogging is further suppressed.

In addition, for the toner of the present exemplary embodiment, the weight average molecular weight of the component that is extracted with a water phase by the addition of ion exchanged water after mixing the toner with methyl ethyl ketone is preferably from 1,000 to 180,000, more preferably from 2,000 to 150,000, even more preferably from 5,000 to 50,000, and particularly preferably from 10,000 to 30,000. Within the above ranges, a toner having a larger positive charging amount is obtained.

For the toner of the present exemplary embodiment, the amount of the component that is extracted by a water phase by the addition of ion exchanged water after mixing the toner with methyl ethyl ketone is preferably from 0.01% by weight to 10% by weight, more preferably from 0.01% by weight to 5% by weight, even more preferably from 0.1% by weight to 3% by weight, and particularly preferably from 0.5% by weight to 2% by weight, based on the total weight of the toner. Within the above ranges, a toner having a larger positive charging amount is obtained, and further, since positive charging stability, particularly hygroscopicity may be suppressed to be low, the positive charging stability under a high-temperature and high-humidity environment is excellent.

Furthermore, for the toner of the present exemplary embodiment, an acid value of the component that is dissolved in an organic phase (MEK phase) by the addition of ion exchanged water after mixing the toner with methyl ethyl ketone is preferably from 5 mgKOH/g to 30 mgKOH/g, more preferably from 7 mgKOH/g to 25 mgKOH/g, and even more preferably from 10 mgKOH/g to 20 mgKOH/g. Within the above ranges, the positive charging stability is excellent.

Polymer Compound Having Amino Group

For the toner of the present exemplary embodiment, the amine value of a component extracted with a water phase by the addition of ion exchanged water after mixing the toner with methyl ethyl ketone is from 600 to 1,250 and the weight average molecular weight of the component extracted with the water phase is from 1,000 to 200,000. Thus, in order to meet the above requirements, the toner includes at least a polymer compound having an amino group ("polymeric amino compound").

For the toner of the present exemplary embodiment, it is preferable that the toner mother particles contain at least a polymer compound having an amino group and it is more preferable that at least a part of the surface of the toner mother particles have at least a polymer compound having an amino group. In the above embodiment, a toner having a larger positive charging amount is easily obtained, and in addition, a sufficient effect is exerted even if the content of the polymer compound having an amino group is small.

The amino group in the polymer compound having an amino group may be a primary amino group, a secondary amino group, and/or a tertiary amino group, but it is preferable that the polymer compound having an amino group have at least a tertiary amino group and it is more preferable that the amino group of the polymer compound having an amino group be a tertiary amino group. In the above embodiment, a toner having a larger positive charging amount is obtained, and further, since the hygroscopicity may be suppressed to be low, the positive charging stability under a high-temperature and high-humidity environment is excellent.

In addition, the primary amino group, the secondary amino group, and the tertiary amino group may form a salt.

The polymer compound having an amino group may be used singly or in combination of two or more kinds thereof.

Examples of the polymer compound having an amino group include polymer compounds such as a polyethylenimine, a polyallylamine, an allylamine salt polymer, a methyldiallylamine salt polymer, a polyvinylamine, a polyamine polyamide epichlorohydrin resin (PAE resin), a dicyandiamide polyalkylenepolyamine condensate, a polyalkylene polyamine dicyandiamide ammonium salt condensate, a dicyandiamide formalin condensate, an epichlorohydrin.dialkylamine addition polymerization product, a diallyldimethylammonium chloride polymerization product, a polyvinylimidazole, a vinylpyrrolidone vinylimidazole copolymerization product, a polyvinyl pyridine, a polyamidine, chitosan, cationized starch, a vinyl benzyl trimethyl ammonium chloride polymerization product, a (2-methacryloyloxyethyl)trimethylammonium chloride polymerization product, a polyalkylaminoethyl acrylate, a polyalkylaminoethyl methacrylate, a polybiguanide, and a polyguanide.

Among these, a polyethylenimine, a polyallylamine, an allylamine salt polymer, and a methyldiallylamine salt polymer are preferable; an allylamine salt polymer and a methyldiallylamine salt polymer are more preferable; and a methyldiallylamine salt polymer is particularly preferable.

Furthermore, examples of a commercially available polymer compound having an amino group include PAA series and PAS series manufactured by Nittobo Medical Co., Ltd., and EPOMIN series manufactured by Nippon Shokubai Co., Ltd.

Furthermore, the preferable embodiments of the amine value, the weight average molecular weight, and the content of the polymer compound having an amino group in the toner of the present exemplary embodiment are each the same as in the preferable embodiments of the component that is extracted with a water phase by the addition of ion exchanged water after mixing the toner with methyl ethyl ketone.

Further, in the toner of the present exemplary embodiment, the component that is extracted with a water phase by the addition of ion exchanged water after mixing the toner with methyl ethyl ketone preferably has a polymer compound having an amino group as a main component (component in the amount of more than 50% by weight based on the total amount), more preferably 80% by weight or more, and even more preferably 90% by weight or more.

Binder Resin

The toner of the present exemplary embodiment contains toner mother particles containing at least a binder resin having an ethylenically unsaturated bond.

The toner mother particles may contain binder resins other than the binder resin having an ethylenically unsaturated bond (hereinafter also referred to as "other binder resins").

Examples of the other binder resins preferably include polyester resins, and more preferably crystalline polyester resins.

Binder Resin Having Ethylenically Unsaturated Bond

The toner of the present exemplary embodiment contains at least a binder resin having an ethylenically unsaturated bond as a binder resin. The specific reason is not clear, but is presumed that a binder resin having an ethylenically unsaturated bond and the polymer compound having an amino group perform(s) a certain interaction and/or reaction, thereby obtaining a positively chargeable toner having excellent positive chargeability and suppressed generation of fogging.

The position of the ethylenically unsaturated bond in the binder resin having an ethylenically unsaturated bond is not particularly limited, and for example, it may be the main chain or the side chain of the resin, or the inner part or the terminal of the main chain or the side chain.

Among these, the binder resin having an ethylenically unsaturated bond preferably has an ethylenically unsaturated bond in at least the main chain, and more preferably has an ethylenically unsaturated bond in both of the main chain and the side chain.

Examples of the binder resin having an ethylenically unsaturated bond include a polyester resin, a copolymer of styrene with an acrylic acid or methacrylic acid, a polyvinyl chloride resin, a phenol resin, an acrylic resin, a methacrylic resin, polyvinyl acetate, a silicone resin, a polyurethane resin, a polyamide resin, a furan resin, an epoxy resin, a xylene resin, a polyvinyl butyral, a terpene resin, a coumarone-indene resin, a petroleum-based resin, and a polyether polyol resin, each of which has an ethylenically unsaturated group.

Among these, the polyester resin having an ethylenically unsaturated bond (hereinafter also simply referred to as an "unsaturated polyester resin") is preferable, and a non-crystalline (also referred to as "amorphous") polyester resin having an ethylenically unsaturated group is more preferable.

The unsaturated polyester resin is synthesized by the polycondensation of a polyol (in the present exemplary embodiment, also referred to a "polyhydric alcohol") component andapolycarboxylic acid (in the present exemplary embodiment, also referred to as a "polyvalent carboxylic acid") component. There is no particular restriction on which monomer unit has the ethylenically unsaturated group included in the unsaturated polyester resin, but from the viewpoint of cost or reactivity, it is preferable that a residue derived from a polycarboxylic acid include an ethylenically unsaturated bond.

Furthermore, as the unsaturated polyester resin, a commercially available product or an appropriately synthesized product may be used.

The unsaturated polyester resin may be either of a non-crystalline polyester resin and a crystalline polyester resin, with the non-crystalline polyester resin being preferable.

As the polycarboxylic acid used for the polycondensation of the unsaturated polyester resin, an aliphatic unsaturated polycarboxylic acid is preferably used, and examples of such an unsaturated polyvalent carboxylic acid include maleic acid, fumaric acid, itaconic acid, citraconic acid, 3-hexenedioic acid, 3-octenedioic acid, dodecenylsuccinic acid, and lower esters, and acid anhydrides thereof. Among these, maleic acid, fumaric acid, dodecenyl succinic acid, lower ester thereof and/or acid anhydrides thereof are more preferable.

Furthermore, the unsaturated polyester resin preferably has at least a monomer unit derived from maleic acid, fumaric acid, and/or dodecenyl succinic acid, and particularly preferably at least a monomer unit derived from maleic acid and/or fumaric acid, and a monomer unit derived from dodecenyl succinic acid.

Examples of other polyvalent carboxylic acid components include, but are not limited to, aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acids, for example, dibasic acids such as phthalic acid, isophthalic acid, terephthalic acid, naphthalene-2,6-dicarboxylic acid, malonic acid, and mesaconic acid; as well as anhydrides thereof and lower alkyl esters thereof.

Examples of the trivalent or higher-valent carboxylic acid include 1,2,4-benzenetricarboxylic acid, 1,2,5-benzenetricarboxylic acid, and 1,2,4-naphthalenetricarboxylic acid, and anhydrides thereof and lower alkyl esters thereof. Further, the "lower alkyl ester" means an ester with an alcohol having 1 to 5 carbon atoms.

These may be used singly or in combination of two or more kinds thereof.

As the polyhydric alcohol component, a dihydric alcohol is preferably used, and examples thereof include alkylene (having 2 to 4 carbon atoms) oxide adducts of bisphenol A (average addition molar number of 1.5 to 6), such as polyoxypropylene (2.2)-2,2-bis(4-hydroxyphenyl)propane and polyoxyethylene (2.2)-2,2-bis(4-hydroxyphenyl)propane, ethylene glycol, propylene glycol, neopentyl glycol, 1,4-butanediol, 1,3-butanediol, and 1,6-hexanediol.

Examples of the trihydric or higher-hydric polyalcohol include sorbitol, pentaerythritol, glycerol, and trimethylolpropane.

Crystalline Polyester Resin

The polyester resin having an ethylenically unsaturated bond may be a crystalline resin.

Furthermore, the toner mother particles preferably contain a crystalline polyester resin, and more preferably contain a crystalline polyester resin as the other binder resin. The use of a crystalline polyester resin as a part of the binder resin may impart low-temperature fixability to the toner.

In the present exemplary embodiment, a combination of a non-crystalline polyester resin having an ethylenically unsaturated bond and a crystalline polyester resin having no ethylenically unsaturated bond is preferably used as the binder resin. In this case, the blending amount of the crystalline polyester resin to the non-crystalline polyester resin is preferably from 2% by weight to 20% by weight, based on the total amount of the non-crystalline polyester resin.

The "crystalline polyester resin" denotes a resin that shows a distinct endothermic peak in differential scanning calorimetry (DSC). That is, the crystalline polyester resin indicates that the resin shows a distinct endothermic peak in differential scanning calorimetry (DSC), specifically, that the half width of the endothermic peak measured at a temperature raising velocity of 10° C./min is within 6° C. On the other hand, a resin having a half width of more than 6° C. and a resin having no distinct endothermic peak are taken as an amorphous resin. Further, in the case where the crystalline resin shows plural melting peaks, a maximum peak is taken as a melting temperature.

Furthermore, the glass transition temperature of the non-crystalline resin refers to a value measured using a method (DSC method) specified in ASTM D3418-82.

The endothermic peak temperature (melting temperature) of the crystalline polyester resin is preferably from 50° C. to 120° C., and more preferably from 55° C. to 100° C. If the endothermic peak temperature is 50° C. or higher, the cohesive force of the binder resin itself in the high temperature region is good, the peelability during fixing is excellent, and the hot off-set may be suppressed. Further, if the endothermic peak temperature is 120° C. or lower, sufficient melting is obtained, and thus, the minimum fixing temperature may be lowered.

The glass transition temperature Tg of the non-crystalline polyester resin is preferably from 40° C. to 80° C., and more preferably from 50° C. to 65° C. If the Tg is 40° C. or higher, the cohesive force of the binder resin itself in the high temperature region is maintained and the hot offset during fixing may be suppressed. Further, if the Tg is 80° C. or lower, sufficient melting is obtained and thus, minimum fixing temperature may be lowered.

The crystalline polyester resin preferably includes an aliphatic dicarboxylic acid and an aliphatic diol, and more preferably includes a linear dicarboxylic acid and a linear aliphatic diol, having 4 to 20 carbon atoms in the main chain. If it is linear, the crystallinity of the polyester resin is excellent, the crystal melting point is suitable, and thus, toner blocking resistance, image preservability, and low-temperature fixability are excellent. Further, if the crystalline polyester resin has 4 or more carbon atoms, the concentration of ester bonds is low, the electrical resistivity is suitable, and the toner chargeability is excellent. In addition, if the crystalline polyester resin has 20 or less carbon atoms, the materials in practical use are easily available. More preferably, the crystalline polyester resin has 14 or less carbon atoms.

Examples of the aliphatic dicarboxylic acid that is suitably used for the synthesis of the crystalline polyester include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, and lower alkyl esters and acid anhydrides thereof. Among these, taking into consideration easiness of availability, sebacic acid and 1,10-decanedicarboxylic acid are preferable.

Specific examples of the aliphatic diol include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these, 1,8-octanediol, 1,9-nonanediol, and 1,10-decanediol are preferable in view of easiness of availability.

Examples of the trihydric or higher-hydric alcohol may include glycerin, trimethylolethane, trimethylolpropane, and pentaerythritol. These may be used singly or in combination of two or more kinds thereof.

Among the polyvalent carboxylic acid components, the content of the aliphatic dicarboxylic acid is preferably 80% by mole or more, and more preferably 90% by mole or more. If the content of the aliphatic dicarboxylic acid component is 80% by mole or higher, the crystallinity of the polyester resin is excellent and the melting point is suitable, and thus, toner blocking resistance, image preservability, and low-temperature fixability are excellent.

The content of the aliphatic diol component among the polyhydric alcohol components is preferably 80% by mole or more, and more preferably 90% by mole or more. If the content of the aliphatic diol component is 80% by mole or more, the crystallinity of the polyester resin is excellent and the melting point is suitable, and thus, toner blocking resistance, image preservability, and low-temperature fixability are excellent.

Non-Crystalline Polyester Resin

The polyester resin having an ethylenically unsaturated bond is preferably a non-crystalline resin.

Furthermore, the toner mother particles may contain a non-crystalline polyester resin as the other binder resin.

As for the non-crystalline polyester resin (hereinafter also referred to as an "amorphous polyester resin"), dihydric or higher-hydric secondary alcohols and/or divalent or higher-valent aromatic carboxylic acid compounds are preferable as the raw material monomer. Examples of the dihydric or higher-hydric secondary alcohol include a propylene oxide adduct of bisphenol A, propylene glycol, 1,3-butanediol, and glycerol. Among these, a propylene oxide adduct of bisphenol A is preferable.

As the divalent or higher-valent aromatic carboxylic acid compound, terephthalic acid, isophthalic acid, phthalic acid, and trimellitic acid are preferable, and terephthalic acid and trimellitic acid are more preferable.

A method for preparing the polyester resin is not particularly limited, irrespective of whether it is crystalline or amorphous, and the polyester resin may be prepared by a general polyester polymerization method, in which a polyol component is reacted with a polycarboxylic acid component. Examples of the polyester polymerization method include a direct polycondensation method and an esterification method, which are distinctly chosen and used to prepare the polyester resin according to the kinds of the monomers. Further, a polycondensation catalyst such as a metal catalyst and a Bronsted catalyst is preferably used.

In the case where the polyol and the polycarboxylic acid are directly subjected to a polycondensation reaction, the polyester resin may be prepared by adding and blending the polyol and the polycarboxylic acid, and optionally, a catalyst in a reaction vessel equipped with a thermometer, a stirrer, and a flow-down-type condenser; heating the mixture at from 150° C. to 250° C. in the presence of an inert gas (a nitrogen gas or the like), thereby continuously removing low-molecular-weight compounds as by-products out of the reaction system; and stopping the reaction at a point of time of reaching a predetermined acid value, followed by cooling to obtain a desired reaction product.

The hydroxyl group value of the binder resin in the toner of the present exemplary embodiment is preferably from 0 mgKOH/g to 10 mgKOH/g, more preferably from 0 mgKOH/g to 8 mgKOH/g, and even more preferably from 0 mgKOH/g to 5 mgKOH/g. Within the above ranges, the chargeability is more excellent.

The acid value of the binder resin in the toner of the present exemplary embodiment is preferably from 5 mgKOH/g to 30 mgKOH/g, more preferably from 7 mgKOH/g to 25 mgKOH/g, and even more preferably from 10 mgKOH/g to 20 mgKOH/g. Within the above ranges, the assembly property of the toner is excellent, and in addition, the dependency of the charging amount on the environment is superior.

Incidentally, the measurements of the acid value and the hydroxyl group value in the present exemplary embodiment is carried out by the following method.

For the acid value and the hydroxyl group value, values measured according to the method (potentiometric titration method) prescribed in JIS K0070-1992 are used. However, when a sample is not dissolved, a solvent such as dioxane and tetrahydrofuran is used as the solvent.

Moreover, the weight average molecular weight of the polyester resin used in the present exemplary embodiment is preferably from 4,000 to 100,000, and more preferably from 6,000 to 80,000. If the weight average molecular weight is 4,000 or more, satisfactory cohesive force for the binder resin may be obtained, and the hot offset property is excellent. Further, if the weight average molecular weight is 100,000 or less, a satisfactory hot offset property and a suitable minimum fixing temperature may be obtained.

Furthermore, examples of the other biding resins include, in addition to the polyester resins, a copolymer of styrene with an acrylic acid or methacrylic acid, a polyvinyl chloride resin, a phenol resin, an acrylic resin, a methacrylic resin, polyvinyl acetate, a silicone resin, a polyurethane resin, a polyamide resin, a furan resin, an epoxy resin, a xylene resin, polyvinyl butyral, a terpene resin, a coumarone-indene resin, and a petroleum-based resin, and a polyether polyol resin, which may be used in combination, if necessary.

Furthermore, the content of the binder resin in the toner mother particles in the toner of the present exemplary embodiment is not particularly limited, but is preferably from 30% by weight to 99% by weight, more preferably from 40% by weight to 98% by weight, and even more preferably from 50% by weight to 96% by weight, based on the total weight of the toner mother particles. Within the above ranges, fixability, storability, powder characteristics, charge characteristics, and the like are excellent.

Colorant

The positively chargeable toner of the present exemplary embodiment may contain a colorant in the toner mother particles.

As the colorant, known colorants may be used, from which any one may be selected from the viewpoints of hue angles, chroma, brightness, weather resistance, OHP penetrating property, and dispersibility in a toner.

For example, for a cyan toner, for example, cyan pigments such as C. I. Pigment Blue 1, C. I. Pigment Blue 2, C. I. Pigment Blue 3, C. I. Pigment Blue 4, C. I. Pigment Blue 5, C. I. Pigment Blue 6, C. I. Pigment Blue 7, C. I. Pigment Blue 10, C. I. Pigment Blue 11, C. I. Pigment Blue 12, C. I. Pigment Blue 13, C. I. Pigment Blue 14, C. I. Pigment Blue 15, C. I.

Pigment Blue 15:1, C. I. Pigment Blue 15:2, C. I. Pigment Blue 15:3, C. I. Pigment Blue 15:4, C. I. Pigment Blue 15:6, C. I. Pigment Blue 16, C. I. Pigment Blue 17, C. I. Pigment Blue 23, C. I. Pigment Blue 60, C. I. Pigment Blue 65, C. I. Pigment Blue 73, C. I. Pigment Blue 83, C. I. Pigment Blue 180, C. I. Vat Cyan 1, C. I. Vat Cyan 3, and C. I. Vat Cyan 20, Prussian Blue, Cobalt Blue, Alkali Blue Lake, Phthalocyanine Blue, metal-free Phthalocyanine Blue, partial chlorination products of Phthalocyanine Blue, Fast Sky Blue, and Indanthrene Blue BC; and cyan dyes such as C. I. Solvent Cyan 79 and 162, and the like are used as the colorant.

For a magenta toner, for example, magenta pigments such as C. I. Pigment Red 1, C. I. Pigment Red 2, C. I. Pigment Red 3, C. I. Pigment Red 4, C. I. Pigment Red 5, C. I. Pigment Red 6, C. I. Pigment Red 7, C. I. Pigment Red 8, C. I. Pigment Red 9, C. I. Pigment Red 10, C. I. Pigment Red 11, C. I. Pigment Red 12, C. I. Pigment Red 13, C. I. Pigment Red 14, C. I. Pigment Red 15, C. I. Pigment Red 16, C. I. Pigment Red 17, C. I. Pigment Red 18, C. I. Pigment Red 19, C. I. Pigment Red 21, C. I. Pigment Red 22, C. I. Pigment Red 23, C. I. Pigment Red 30, C. I. Pigment Red 31, C. I. Pigment Red 32, C.I. Pigment Red 37, C. I. Pigment Red 38, C. I. Pigment Red 39, C. I. Pigment Red 40, C. I. Pigment Red 41, C. I. Pigment Red 48, C. I. Pigment Red 49, C. I. Pigment Red 70, C.I. Pigment Red 51, C. I. Pigment Red 52, C. I. Pigment Red 53, C. I. Pigment Red 54, C.I. Pigment Red 55, C. I. Pigment Red 57, C. I. Pigment Red 58, C. I. Pigment Red 60, C. I. Pigment Red 63, C. I. Pigment Red 64, C. I. Pigment Red 68, C. I. Pigment Red 81, C. I. Pigment Red 83, C. I. Pigment Red 87, C. I. Pigment Red 88, C. I. Pigment Red 89, C. I. Pigment Red 90, C. I. Pigment Red 112, C. I. Pigment Red 114, C.I. Pigment Red 122, C. I. Pigment Red 123, C. I. Pigment Red 163, C. I. Pigment Red 184, C. I. Pigment Red 185, C. I. Pigment Red 202, C. I. Pigment Red 206, C. I. Pigment Red 207, C. I. Pigment Red 209, and C. I. Pigment Red 238; magenta pigments such as C. I. Pigment Violet 19; magenta dyes such as C. I. Solvent Red 1, C. I. Solvent Red 3, C. I. Solvent Red 8, C. I. Solvent Red 23, C. I. Solvent Red 24, C. I. Solvent Red 25, C. I. Solvent Red 27, C. I. Solvent Red 30, C. I. Solvent Red 49, C. I. Solvent Red 81, C. I. Solvent Red 82, C. I. Solvent Red 83, C. I. Solvent Red 84, C. I. Solvent Red 100, C. I. Solvent Red 109, C. I. Solvent Red 121, C. I. Disperse Red 9, C. I. Basic Red 1, C. I. Basic Red 2, C. I. Basic Red 9, C. I. Basic Red 12, C. I. Basic Red 13, C. I. Basic Red 14, C. I. Basic Red 15, C. I. Basic Red 17, C. I. Basic Red 18, C. I. Basic Red 22, C. I. Basic Red 23, C. I. Basic Red 24, C. I. Basic Red 27, C. I. Basic Red 29, C. I. Basic Red 32, C. I. Basic Red 34, C. I. Basic Red 35, C. I. Basic Red 36, C. I. Basic Red 37, C. I. Basic Red 38, C. I. Basic Red 39, and C. I. Basic Red 40; Bengal red iron oxide, Cadmium Red, minium, mercury sulfide, cadmium, Permanent Red 4R, Lithol Red, Pyrazolone Red, Watching Red, calcium salts, Lake Red D, Brilliant Carmine 6B, Eosin Lake, Rhodamine Lake B, Alizarin Lake, Brilliant Carmine 3B, and the like are used as the colorant.

For a yellow toner, for example, yellow pigments such as C. I. Pigment Yellow 2, C. I. Pigment Yellow 3, C. I. Pigment Yellow 15, C. I. Pigment Yellow 16, C. I. Pigment Yellow 17, C. I. Pigment Yellow 74, C. I. Pigment Yellow 93, C. I. Pigment Yellow 97, C. I. Pigment Yellow 128, C. I. Pigment Yellow 155, C. I. Pigment Yellow 180, C. I. Pigment Yellow 185, and C. I. Pigment Yellow 139 are used as the colorant.

In addition, for a black toner, for example, carbon black, activated carbon, titanium black, magnetic powders, Mn-containing non-magnetic powders, and the like may be used as the colorant. Further, a black toner may used, which is formed by mixing a yellow pigment, a magenta pigment, a cyan pigment, a red pigment, a green pigment, and a blue pigment.

The amount of the colorant used is preferably from 0.1 part by weight to 20 parts by weight, and more preferably from 0.5 part by weight to 15 parts by weight, based on 100 parts by weight of the toner mother particles. Further, as the colorant, these pigments, dyes, or the like may be used singly or in combination of two or more kinds thereof.

Release Agent

The positively chargeable toner of the present exemplary embodiment preferably contains a release agent in the toner mother particles.

Specific examples of the release agent include an ester wax, a polyethylene, a polypropylene, a copolymerization product of a polyethylene and a polypropylene, a polyglycerin wax, a microcrystalline wax, a paraffin wax, a carnauba wax, a sasol wax, a montanic ester wax, a deoxidized carnauba wax, unsaturated fatty acids such as palmitic acid, stearic acid, montanic acid, brassidic acid, eleostearic acid, and parinaric acid, saturated alcohols such as stearyl alcohol, aralkyl alcohol, behenyl alcohol, carnaubyl alcohol, ceryl alcohol, melissyl alcohol, and long-chain alkyl alcohols having a long chain alkyl group; polyhydric alcohols such as sorbitol; fatty acid amides such as linoleic acid amide, oleic acid amide, and lauric acid amide; saturated fatty acid bisamides such as methylene bisstearic acid amide, ethylene biscapric acid amide, ethylene bislauric acid amide, and hexamethylene bisstearic acid amide; unsaturated fatty acid amides such as ethylene bisoleic acid amide, hexamethylene bisoleic acid amide, N,N'-dioleyladipic acid amide, and N,N'-dioleylsebacic acid amide; aromatic bisamides such as m-xylenebisstearic acid amide and N,N'-distearylisophthalic acid amide; fatty acid metal salts (those generally called metal soaps) such as calcium stearate, calcium laurate, zinc stearate, and magnesium stearate; waxes obtained by grafting a vinyl monomer such as styrene and an acrylic acid onto an aliphatic hydrocarbon type wax; partially esterified products of a fatty acid such as behenic acid monoglyceride and a polyhydric alcohol; and methyl ester compounds having a hydroxyl group, obtained by hydrogenation of a vegetable oil, or the like.

The amount of the release agent contained is preferably in the range of 1% by weight to 20% by weight, and more preferably in the range of 3% by weight to 15% by weight, based on 100% by weight of the binder resin. Within the above ranges, both of satisfactory fixing and image quality characteristics may be satisfied.

Charge-Controlling Agent

The positively chargeable toner of the present exemplary embodiment may contain a charge-controlling agent, if necessary, but preferably does not contain the charge-controlling agent.

The charge-controlling agent is not particularly limited and known charge-controlling agents may be used according to the purposes. Examples of the charge-controlling agent include a nigrosine dye, quaternary ammonium salts such as tributylbenzylammonium-1-hydroxy-4-naphtholsulfonates and tetrabutylammoniumtetrafluoroborate, and onium salts such as phosphonium salts that are analogues of the above compounds, and lake pigments thereof; a triphenyl methane dye; metal salts of higher fatty acids; diorganotin oxides such as dibutyl tin oxide, dioctyl tin oxide, and dicyclohexyl tin oxide; diorganotin borates such as dibutyltin borate; guanidine compounds, imidazole compounds, and amino-acrylic resins.

These charge-controlling agents may be used singly or in combination of two or more kinds thereof.

The volume average particle diameter ($D_{50v}$) of the positively chargeable toners of the present exemplary embodiment is preferably from 2 μm to 10 μm, more preferably from 3 μm to 9 μm, and even more preferably from 4 μm to 8 μm.

Furthermore, the volume average particle diameter ($D_{50v}$) of the toner mother particles in the positively chargeable toner of the present exemplary embodiment is preferably from 2 μm to 10 μm, more preferably from 3 μm to 9 μm, and even more preferably from 4 μm to 8 μm.

The particle size distribution of the toner is preferably as narrow as possible, and more specifically, it is the square root (GSDp) of a ratio of a 16% diameter ($D_{16p}$) to a 84% diameter ($D_{84p}$), drawn from the side of a smaller number particle diameter of the toner. That is, the GSDp represented by the following formula is preferably 1.40 or less, more preferably 1.31 or less, and particularly preferably 1.27 or less.

$$GSDp=\{(D_{84p})/(D_{16p})\}^{0.5}$$

If both of the volume average particle diameter and the GSDp are within the above ranges, extremely small particles are not present, and therefore, the reduction in the developability by excess charging amounts of the toners having small particle diameter may be suppressed.

For the measurement of the average particle diameter of the particles for toners, toner mother particles, or the like, Coulter Multisizer II type (manufactured by Beckman Coulter, Inc.) may be used. In this case, according to the particle diameter levels of the particles, the average particle diameter may be measured using an optimal aperture. The particle diameter of the particle measured is expressed in a volume average particle diameter.

Method for Preparing Positively Chargeable Toner

The method for preparing the positively chargeable toner of the present exemplary embodiment is not particularly limited, and may be prepared by a known method.

For example, a kneading pulverizing method in which a binder resin, a colorant, a release agent, and optionally, components such as a charge-controlling agent, an infrared ray absorbent, and the like are mixed, the materials are then melt-kneaded using a kneader, an extruder, or the like, and subsequently, the obtained melt-kneaded product is coarsely ground, and then finely pulverized with a jet mill or the like to obtain toner mother particles having desired particle diameters by a wind-force classifier; a method in which the shapes of the particles obtained by the kneading pulverizing method are changed by a mechanic impact force or thermal energy; an emulsion aggregation method in which a binder resin is emulsified, the formed dispersion is optionally mixed with a dispersion of a colorant, a dispersion of a release agent, and/or a dispersion of a charge-controlling agent and the like, and the mixture is aggregated, heated, and fused to obtain toner mother particles; a suspension polymerization method in which polymerizable monomers for obtaining a binder resin and a solution containing a colorant, a release agent, and optionally a charge-controlling agent and the like, are suspended in a water-based solvent and polymerized therein; and a dissolution suspension method in which a binder resin and a solution containing a colorant, a release agent, and optionally, a charge-controlling agent and the like, are suspended in an aqueous solvent to form particles, may be used. Moreover, a method for preparing a toner having a core-shell structure in which aggregated particles are further attached to the toner mother particles obtained by the above-described method, as a core, and then heated and coalesced may be carried out.

Among these, a kneading pulverizing method or an emulsification aggregation method is preferably used to prepare the toner of the present exemplary embodiment.

The method for externally adding an external additive to the toner is not particularly limited, and known methods may be used. Specific examples of the methods include an attachment method in which an external additive is attached to the surface of toner mother particles in a dry type manner using a mixer such as a V blender and a Henschel mixer, a method in which external additives are dispersed in a liquid and then added to a toner in a slurry state, followed by drying and attaching to the surface, and a method of drying the slurry while spraying on the dry toner as a wet method.

Furthermore, the method for preparing the positively chargeable toner of the present exemplary embodiment preferably includes an adjustment step of adjusting the dispersion including particles containing at least a binder resin having an ethylenically unsaturated bond to lower than the glass transition temperature of the binder resin, as well as to a temperature of 40° C. to 70° C. and a pH of 4.0 to 9.0; and an amine adding step of adding a polymeric amine compound to the dispersion having the temperature and pH adjusted in the adjustment step, after the adjustment step. With the embodiment, the polymer amine compound may be uniformly attached to the surface of the toner mother particles, thereby easily obtaining a toner having excellent positive chargeability. Further, with the embodiment, it is presumed that the polymer amine compound and the binder resin having an ethylenically unsaturated bond undergo a certain interaction and/or reaction, and it is also presumed that such the interaction and/or reaction leads to a toner having excellent positive charging stability.

The glass transition temperature of the binder resin in the adjustment step is preferably glass transition temperature of the non-crystalline resin included in the particles, and more preferably the glass transition temperature of the non-crystalline resin having an ethylenically unsaturated bond. Further, the non-crystalline resin which is the standard for the glass transition temperature is preferably a main component (component occupying more than 50% by weight of the total amount) of the binder resin included in the particles.

The temperature for adjustment in the adjustment step is preferably from 40° C. to 65° C., more preferably from 45° C. to 60° C., and even more preferably from 45° C. to 59° C. Further, the temperature for adjustment in the adjustment step is preferably a temperature which is lower from the glass transition temperature of the binder resin by 1° C. or more.

Furthermore, the pH for adjustment in the adjustment step is preferably from 4.0 to 9.0, more preferably from 5.0 to 9.0, and even more preferably from 6.0 to 9.0.

The amount of the polymer amine compound to be added in the amine adding step is preferably from 0.02% by weight to 15% by weight, more preferably from 0.02% by weight to 10% by weight, even more preferably from 0.2% by weight to 5% by weight, and particularly preferably from 0.5% by weight to 2% by weight, based on the total weight of particles containing at least a binder resin having an ethylenically unsaturated bond. Within the above ranges, the positive charging amount is larger, and the positive charging stability, particularly hygroscopicity may be suppressed to be low, and accordingly, a toner having excellent positive charging stability under a high-temperature and high-humidity environment is easily obtained.

Furthermore, the method for preparing the positively chargeable toner of the present exemplary embodiment preferably includes, before the adjustment step, a step of dispersing a resin containing the binder resin having an ethylenically unsaturated bond in a water-based medium to obtain a resin particle dispersion; a step of aggregating the resin particles in a dispersion including at least the resin particle dispersion to obtain aggregated particles; and a step of heating and fusing the aggregated particles. With the embodiment, a dispersion including particles containing at least a binder resin having an ethylenically unsaturated bond is easily obtained.

Electrostatic Charge Image Developer

The electrostatic charge image developer of the present exemplary embodiment (hereinafter also simply referred to as a "developer") may include the positively chargeable toner of the present exemplary embodiment and a carrier.

As the carrier, known carriers may be used, and a resin coating carrier having a resin coating layer including a conductive material on the surface of a core material may be used.

The carrier having a resin coating layer including a conductive material on the surface of a core material is obtained by coating a core material with a resin in, for example, a spray drying manner, a rotary drying manner, a liquid immersion method using a universal stirrer, or the like.

Incidentally, the resin coating layer is not limited to monolayers, but may be configured to be a combination of two or more layers.

Examples of the coating resin used to coat the surface of the core material include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a fluorine resin, a polyester, a polycarbonate, and a phenol resin.

Particularly, the outermost surface of the resin coating layer is preferably formed with a crosslinkable resin. By using the crosslinkable resin, the external additive is filled into the surface of the carrier and thus, the change in the external addition structure may be suppressed.

Examples of the crosslinkable resin include a polyurethane resin, a phenol resin, a urea resin, a melamine resin, a guanamine resin, a melamine-urea cocondensation resin, a crosslinkable fluorine-based resin, an epoxy resin, and a crosslinkable silicone resin.

Among these, an epoxy resin and a crosslinkable silicone resin are preferable, and as the crosslinkable silicone resin, a straight crosslinkable silicone resin and a fluorine-modified silicone resin are preferable.

Specific examples of the conductive materials include metals such as gold, silver, and copper; carbon black; single-component conductive metal oxides such as titanium oxide and zinc oxide; composite materials obtained by coating, with a conductive metal oxide, the surfaces of microparticles such as titanium oxide, zinc oxide, aluminum borate, potassium titanate, tin oxide, and indium tin oxide.

Furthermore, additives such as a charge-controlling agent may be added to the coating resin, if necessary.

The total content of the resin coating layer in the carrier is preferably in the range of from 0.5 part by weight to 10 parts by weight, more preferably in the range of from 1 part by weight to 5 parts by weight, and even more preferably in the range of from 1 part by weight to 3 parts by weight, based on 100 parts by weight of the core material. If the content of the resin coating layer is 0.5 part by weight or more, the exposure of the surface of the core material particle is reduced and the injection of the development field may be suppressed. Further, if the content of the resin coating layer is 10 parts by weight or less, the resin powder freed from the resin coating layer is reduced, and thus, the resin powder peeled in the developer may be suppressed from the initial stage.

The average film thickness of each of the resin coating layers is preferably from 0.1 μm to 10 μm, more preferably from 0.1 μm to 3.0 μm, and even more preferably from 0.1 μm to 1.0 μm. If the average film thickness of the resin coating layer is 0.1 μm or more, reduction in the resistivity due to the peeling of the resin coating layer during the long-term use does not occur, and thus, the pulverizing of the carrier may be easily controlled. On the other hand, if the average film thickness of the resin coating layer is 10 μm or less, the time taken to reach a saturated charge amount is short.

The average film thickness (μm) of the resin coating layer may be obtained according to the following expression (11) from the true specific gravity ρ (dimensionless) of the core material, the volume average particle diameter d (μm) of the core material, the average specific gravity $\rho_c$ of the resin coating layer, and the total content $W_c$ (part by weight) of the resin coating layer per 100 parts by weight of the core material.

Formula (11)

$$\text{Average thickness } (\mu m) = \{(\text{amount of coated resin per carrier (including additives such as conductive powder)/surface area of one carrier)}\}/\text{average specific gravity of resin coating layer} = \{[4/3\pi\cdot(d/2)^3\cdot\rho\cdot W_c]/[4\pi\cdot(d/2)^2]\}/\rho_c = (1/6)\cdot(d\cdot\rho\cdot W_c/\rho_c)$$

The content of the conductive material is preferably from 0.5 part by weight to 20 parts by weight, and more preferably from 2 parts by weight to 18 parts by weight, based on 100 parts by weight of the coating resin. If the content is in the range of 0.5 part by weight to 20 parts by weight, the resistivity of the carrier may be controlled satisfactorily.

The average particle diameter of the carrier is preferably from 20 μm to 100 μm, and more preferably from 30 μm to 80 μm.

The content of the toner of the electrostatic charge image developer of the present exemplary embodiment is preferably from 2.0 parts by weight to 20 parts by weight, more preferably from 2.5 parts by weight to 16 parts by weight, and even more preferably from 3.0 parts by weight to 14 parts by weight, based on the 100 parts by weight of the developer.

Image Forming Method and Image Forming Apparatus

The positively chargeable toner of the present exemplary embodiment and the electrostatic charge image developer of the present exemplary embodiment are not particularly limited, and are used in image forming methods and apparatuses of an electrostatic charge image developing system (electrophotographic system).

The image forming method of the present exemplary embodiment preferably includes at least a latent image forming step of forming an electrostatic latent image on a surface of an image holding member; a development step of developing the electrostatic latent image formed on the surface of the image holding member by a developer containing the positively chargeable toner of the present exemplary embodiment to form a toner image; a transfer step of transferring the toner image onto a surface of a transfer member; and a fixing step of fixing the toner image transferred onto the surface of the transfer member. In the transfer step, the transfer may be carried out two or more times using an intermediate transfer member. Further, the method may include a cleaning step, if necessary.

Furthermore, the image forming apparatus of the present exemplary embodiment preferably includes at least an image holding member, an electrostatic charge image forming unit that forms an electrostatic charge image on the surface of the image holding member; a developing unit that develops the electrostatic charge image by a developer containing the positively chargeable toner of the present exemplary embodiment to form a toner image; a transfer unit that transfers the toner image onto the surface of a transfer member; and a fixing unit that fixes the toner image transferred onto the surface of the transfer member. In the transfer unit, the transfer may be carried out two or more times using an intermediate transfer member. In addition, the image forming apparatus may include a cleaning unit that removes the toner remaining on the image holding member, or the like.

Examples of the photoreceptor which is the image holding member include inorganic photoreceptors such as amorphous silicon and selenium, and organic photoreceptors using polysilane, phthalocyanine, or the like as a charge generating material or a charge transporting material.

Furthermore, each of the steps in the image forming method is described in, for example, JP-A-56-40868, JP-A-49-91231, and the like. Further, the image forming method of the present exemplary embodiment is implemented using a per se known image forming apparatus such as a copier and a facsimile machine.

The latent image forming step is a step of forming an electrostatic latent image on the surface of an image holding member.

The development step is a step of developing the electrostatic latent image by a developer layer on the developer holding member to form a toner image. The developer layer is not particularly limited as long as it contains the electrostatic charge image developer of the present exemplary embodiment containing the electrostatic charge image developing toner of the present exemplary embodiment.

The transfer step is a step of transferring the toner image onto a transfer member.

The fixing step is a step of fixing the toner image transferred onto a recording medium such as recording paper by a light fixing device, a heat fixing device, or the like to form a copied image.

The cleaning step is a step of cleaning the electrostatic charge image developer remaining on the image holding member. An embodiment, in which the image forming method of the present exemplary embodiment further includes a recycling step, is preferable.

The recycling step is a step of transferring the toner for developing an electrostatic charge image that has been recovered in the cleaning step to a developer layer. The image forming method of the embodiment including the recycling step is carried out by using an image forming apparatus such as a copier and a facsimile machine, of a toner recycling system type. Further, it may also be applied to a recycling system in an embodiment in which a toner is recovered at the same time with the development while skipping the cleaning step.

Through these series of treatment steps, a desired replicated product (printed matter or the like) may be obtained.

Furthermore, each of the units in the image forming apparatus preferably employs the configurations described in each of the steps of the image forming method.

For each of the units above, any of known units in the image forming apparatus may be used. Further, the image forming apparatus used in the present exemplary embodiment may include units, devices, and the like other than the above-described configurations. In addition, in the image forming apparatus used in the present exemplary embodiment, plural units above may be carried out simultaneously.

Toner Cartridge and Process Cartridge

The toner cartridge of the present exemplary embodiment is a toner cartridge, which is detachable from an image forming apparatus including at least a developing unit that develops an electrostatic charge image to form a toner image; and accommodates the positively chargeable toner of the present exemplary embodiment as a toner to be supplied to the developing unit.

Furthermore, the process cartridge of the present exemplary embodiment is a process cartridge which is detachable from an image forming apparatus including at least a developing unit that develops the electrostatic charge image to form a toner image; includes a developing unit that develops the electrostatic charge image to form a toner image, and at least one selected from the group consisting of an image holding member, a charging unit that charges the surface of the image holding member, and a cleaning unit that removes the toner remaining on the surface of an image holding member; and accommodates at least the positively chargeable toner of the present exemplary embodiment or the electrostatic charge image developer of the present exemplary embodiment.

The toner cartridge and the process cartridge may employ well-known constitutions. For example, reference may be made to, for example, JP-A-2008-209489 and JP-A-2008-203736.

EXAMPLES

Hereinbelow, the present exemplary embodiments will be described in detail with reference to Examples, which are not construed to limit to the exemplary embodiments. Further, in the following description, "part(s)" mean(s) "part(s) by weight" unless otherwise specified.

Measurement Method

Method for Extraction of Amine in Toner

To a beaker are added 5 g of a toner and 100 g of methyl ethyl ketone (MEK), followed by stirring at room temperature (25° C.) for 1 hour to dissolve the components other than the insoluble components such as external additives and pigments in the toner in MEK. Thereafter, to the beaker is added 100 g of ion exchanged water, followed by stirring for 1 hour and then being left to stand for 1 hour. The precipitates are removed and the water phase portion is separated from the MEK phase to obtain an aqueous amine solution. The obtained aqueous amine solution is dried in a vacuum dryer to extract the amine compound.

Method for Measuring Amine Value

About 0.5 g of the amine compound obtained above is precisely weighed into a 100-ml Erlenmeyer flask, in which 25 ml of methanol has been added, 2 to 3 droplets of an indicator (a solution formed by mixing a solution having 0.20 g of methanol orange dissolved in 50 mL of ion exchanged water and a solution having 0.28 g of xylene cyanol dissolved in 50 ml of methanol) are added thereto, followed by titration a N/2 hydrochloric acid-ethanol solution until the green color changed into the blue-gray color. At this time, the amine value is calculated by a formula (1), taking the amount of the N/2 hydrochloric acid-ethanol solution used for the titration as Bg. In the formula (1), w is the amount of a sample precisely weighed and f is a factor of the N/2 hydrochloric acid-ethanol solution.

$$\text{Amine value}=(\text{number of ml of HCl}\times\tfrac{1}{2}\times f\times 56.11)/w \qquad \text{Formula (1)}$$

Method for Extraction of Binder Resin by MEK

To a beaker are added 5 g of a toner and 100 g of MEK, followed by stirring at room temperature (25° C.) for 1 hour to dissolve the contents other than the insoluble components such as external additives and pigments in the toner in MEK. Thereafter, to the beaker is added 100 g of ion exchanged water, followed by stirring for 1 hour and then being left to stand for 1 hour. The precipitate and the water phase are excluded, and the MEK phase is separated to obtain a resin-dissolved solution, from which the amine compound has been removed. The obtained resin-dissolved solution is dried in a vacuum dryer to extract the binder resin of the toner.

Method for Measuring Acid Value

The acid value (AV) of the toner or the resin is measured in the following manner. The basic operation thereof is based on JIS K-0070-1992.

1.5 g of the pulverized sample of the binder resin obtained above is precisely measured and put in a 300-ml beaker, to which 100 ml of a mixed solution of toluene/ethanol (4/1) is added and dissolved. Potentiometric titration is carried out with 0.1 mol/l of an ethanol solution of KOH, using an automatic titrator, GT-100 (trade name) manufactured by Dia Instruments Co., Ltd. The amount of KOH solution used at this time is defined as A (ml), and at the same time, the blank is measured and the amount of KOH solution used at this time is defined as B (ml). The acid value is calculated from the following formula (2) from those values. In the formula (2), w is the amount of a sample precisely weighed and f is a factor of KOH.

$$\text{Acid value(mgKOH/g)}=\{(A-B)\times f\times 5.61\}/w \qquad \text{Formula (2)}$$

Method for Measuring Endothermic Peak Temperature and Glass Transition Temperature of Resin The glass transition temperature (Tg) of the resin may be obtained using a differential scanning calorimeter (DSC-60A, manufactured by Shimadzu Corporation) in accordance with ASTM D3418. For a sample, an aluminum pan is used, while a blank aluminum pan is set as a control. The temperature is elevated at a heating rate of 10° C./minute and kept at 200° C. for 5 minutes, is decreased from 200° C. to 0° C. using liquid nitrogen at −10° C./minute and kept at 0° C. for 5 minutes. Again, the temperature is elevated from 0° C. to 200° C. at 10° C./minute. Analysis is carried out from the endothermic curve at the second elevation of the temperature. For the amorphous resin, an onset temperature is denoted as Tg, and for the crystalline resin, as an endothermic peak temperature from the maximum peak.

Method for Measuring Softening Temperature

The softening temperature is determined as a ½ flow temperature ($T_{f1/2}$) corresponding to the half value of the height from the initiation point to the termination point of the flow when a 1-$cm^3$ sample is melted and allowed to flow in an elevated flow tester CFT-500 (manufactured by Shimadzu Co.) under the conditions of a die micropore diameter of 0.5 mm, an applied load of 0.98 MPa (10 kg/$cm^2$), and a temperature rising rate of 1° C./min.

Method for Measuring Weight Average Molecular Weight and Molecular Weight Distribution of Resin In the invention, the molecular weights of the binder resin and the like are measured under the following conditions. For GPC, "HLC-8120GPC and SC-8020 devices (manufactured by Tosoh Corporation)" are used and two columns of "TSK-gel, SuperHM-H (manufactured by Tosoh Corporation, 6.0 mm ID×15 cm)" are used as columns, and THF (tetrahydrofuran) is used as an eluent. The experimental conditions are as follows: a sample concentration of 0.5%, a flow rate of 0.6 ml/min, a sample injection amount of 10 μl, a measurement temperature of 40° C., and an IR detector are used to perform experiment. Further, a calibration curve is prepared from 10 samples, "polystyrene standard sample TSK standard": "A-500", "F-1", "F-10", "F-80", "F-380", "A-2500", "F-4", "F-40", "F-128", "F-700", all manufactured by Tosoh Corporation.

Method for Measuring Volume Average Particle Diameter of Toner

The volume average particle diameter of the toner is measured using a Coulter Multisizer II (manufactured by Beckman Coulter, Inc.). As the electrolytic solution, ISOTON-II (manufactured by Beckman Coulter, Inc.) is used.

For this measurement method, 0.5 mg to 50 mg of a measurement sample is put into 2 mL of an aqueous surfactant solution, which is preferably an 5% aqueous solution of sodium alkylbenzenesulfonate, as a disperser, and is then added to 100 mL to 150 mL of the electrolytic solution. The electrolytic solution having the measurement sample suspended therein is subjected to a dispersion treatment for about 1 minutes with an ultrasonic dispersing device, and the particle size distribution of the particles having a particle diameter in the range of 2.0 μm to 60 μm is measured with the Coulter Multisizer II using an aperture having an aperture size of 100 μm. The number of particles to be measured is 50,000.

The particle size distribution thus measured is divided into particle size ranges (channels), and an accumulated distribution is drawn for volume from the small size side. The particle diameter at an accumulation of 50% is defined as a volume average particle diameter.

Method for Measuring Volume Average Particle Diameter of Carrier

The volume average particle diameter of the carrier is measured using, a laser diffraction/scattering particle size distribution measuring device (LS Particle Size Analyzer LS13, 320, manufactured by Beckman Coulter, Inc.). The particle size distribution thus measured is divided into particle size ranges (channels), and an accumulated distribution is drawn for volume from the small size side. The particle diameter at an accumulation of 50% is defined as a volume average particle diameter.

Preparation of Amorphous Polyester Resin 1

| | |
|---|---|
| Bisphenol A propylene oxide 2 moles adduct | 310 parts |
| Terephthalic acid | 116 parts |
| Fumaric acid | 12 parts |
| Dodecenyl succinic acid | 54 parts |
| $Ti(OC_4H_9)_4$ | 0.05 part |

In a three-necked flask dried by heating, the raw materials are placed. Then, air in the three-necked flask is evacuated by a pressure reduction operation and replaced with nitrogen gas to create an inert atmosphere, and reflux is performed under mechanical stirring at 180° C. for 8 hours. Then, the temperature is gradually increased to 230° C. while water produced in the reaction system is removed by distillation under reduced pressure. Further, the dehydration condensation reaction is continued for 2 hours at 240° C. When a viscous state is observed, the molecular weight is determined by GPC. When the weight average molecular weight is 18,000, the distillation under reduced pressure is stopped to obtain an amorphous polyester 1. The amorphous polyester resin 1 is amorphous, and has a glass transition temperature of 60° C., a softening temperature of 105° C., and an acid value of 14 mgKOH/g.

Preparation of Amorphous Polyester Resin Particle Dispersion 1

100 parts of the amorphous polyester resin 1, 50 parts of ethyl acetate, 25 parts of isopropyl alcohol, and 5 parts of a 10%-by-weight aqueous ammonia solution are placed in a separable flask, followed by sufficient mixing and dissolution. Then, ion-exchanged water is added dropwise thereto at a liquid feeding rate of 8 g/min using a liquid feeding pump under heating and stirring at 40° C. After the solution becomes white-cloudy, the liquid feeding rate is increased to 25 g/min to produce phase inversion. When the liquid feeding amount becomes 135 parts, the dropping is stopped. Then, the solvent is removed under reduced pressure to obtain an amorphous polyester resin particle dispersion 1. The volume average particle diameter of the amorphous polyester resin particles is 135 nm, and the solid concentration of the amorphous polyester resin particles is 32.0% by weight.

Preparation of Crystalline Polyester Resin 1

In a three-necked flask dried by heating, 230 parts of 1,10-dodecane diacid, 160 parts of 1,9-nonanediol, and 0.2 part of dibutyl tin oxide as a catalyst are placed. Then, air in the three-necked flask is evacuated by a pressure reduction operation and replaced with nitrogen gas to create an inert atmosphere, stirring is performed under mechanical stirring at 180° C. for 5 hours, and the reaction is continued under reflux. Further, water produced in the reaction system is removed by distillation. Then, the temperature is gradually increased to 235° C. under reduced pressure and stirring is performed for 2 hours. When a viscous state is observed, the molecular weight is confirmed by GPC. When the weight average molecular weight is 28,500, the distillation under reduced pressure is stopped to obtain a crystalline polyester resin 1. The crystalline polyester resin 1 has a melting temperature of 73° C., a softening temperature of 75° C., and an acid value of 12.5 mgKOH/g.

Preparation of Crystalline Polyester Resin Particle Dispersion 1

100 parts of the crystalline polyester resin 1, 35 parts of ethyl acetate, and 35 parts of isopropyl alcohol are placed in a separable flask, followed by sufficient mixing and dissolution at 75° C., and then 5.5 parts of a 10%-by-weight aqueous ammonia solution is added dropwise thereto. The heating temperature is lowered to 60° C., and ion-exchanged water is added dropwise thereto at a liquid feeding rate of 6 g/min using a liquid feeding pump under stirring. After the solution becomes white-cloudy, when the liquid feeding rate is increased to 25 g/min and thus, the liquid feeding amount becomes 400 parts, the dropping of ion-exchanged water is stopped. Then, the solvent is removed under reduced pressure to obtain a crystalline polyester resin particle dispersion 1. The volume average particle diameter of the obtained crystalline polyester resin particles is 140 nm and the solid concentration of the crystalline polyester resin particles is 26.21% by weight.

Preparation of Release Agent Particle Dispersion 1

Using Fischer-Tropsch wax (melting temperature 92° C., manufactured by Nippon Seiro Co., Ltd.), a release agent particle dispersion 1 is prepared.

| | |
|---|---|
| Fischer-Tropsch wax (melting temperature of 92° C., manufactured by Nippon Seiro Co., Ltd.) | 180 parts |
| Anionic surfactant (NEOGEN R, manufactured by Dai-ichi Kogyo Seiyaku Co., Ltd.) | 4.5 parts |
| Ion exchanged water | 410 parts |

The above-described components are heated to 110° C. and dispersed using a homogenizer (manufactured by IKA Laboratories, Ltd.: ULTRA-TURRAX T50), and then subjected to a dispersion treatment with a Manton Gaulin high-pressure homogenizer (Gaulin Corp.) to disperse release agent particles having a volume average particle diameter of 0.24 μm. The concentration of the release agent particles are adjusted by ion-exchanged water to prepare a release agent particle dispersion 1 having a solid concentration of the release agent particles of 31.0% by weight.

Preparation of Colorant Particle Dispersion (Cyan)

| | |
|---|---|
| C.I. Pigment Blue 15:3 (copper phthalocyanine-based cyan pigment, manufactured by Dainichiseika Color & Chemicals Mfg. Co., Ltd.) | 13.75 parts |
| Anionic surfactant (NEOGEN R, manufactured by Dai-ichi Kogyo Seiyaku Co., Ltd.) | 1.238 parts |
| Ion exchanged water | 41.697 parts |

The above components are mixed and dispersed with a high pressure impact type disperser Altimizer (HJP30006, manufactured by Sugino Machine, Ltd.) for 1 hour to obtain a colorant particle dispersion. The volume average particle diameter of the colorant particles in the colorant particle dispersion is 0.18 μm, and the solid concentration of the colorant particles is 26.44% by weight.

Example 1

Preparation of Toner Particles 1

| | |
|---|---|
| Amorphous Polyester Resin Particle Dispersion 1 | 490.6 parts |
| Release Agent Particle Dispersion | 87.9 parts |
| Colorant Particle Dispersion | 45.3 parts |
| Crystalline Polyester Resin Particle Dispersion 1 | 53.2 parts |
| Ion Exchanged Water | 610 parts |
| Anionic surfactant (NEOGEN R, manufactured by Dai-ichi Kogyo Seiyaku Co., Ltd.) | 2.25 parts |

In a polymerization vessel equipped with a pH meter, a stirring blade, and a thermometer, the above-described raw materials are placed. While applying a shear force at 6,000 rpm with ULTRA-TURRAX (manufactured by IKA Laboratories, Ltd.), 100 parts of a 1%-by-weight aluminum sulfate solution is added dropwise as an aggregating agent thereto to prepare a mixture of the raw materials.

Then, the mixture of the raw materials is stirred at 550 rpm to 650 rpm while warming to 30° C. with a mantle heater. After stirring for 60 minutes, formation of primary particles is confirmed using a Coulter Multisizer (aperture diameter: 100 μm, manufactured by Beckmann-Coulter Inc.), and then the temperature is increased at 0.5° C./min to make the aggregated particles grow. The aggregated particle diameters are confirmed several times using the Coulter Multisizer. When the volume average particle diameter of the aggregated particles becomes 6.3 μm, a dilution of 175 parts of the amorphous polyester resin particle dispersion 1 in 48 parts of ion exchanged water is added to coat the aggregated particles. In order to stop the growth of the aggregated particles (attached particles), 20.0 parts of an aqueous ethylenediaminetetraacetic acid (EDTA) solution (Chelest 40, manufactured by Chelest Corporation, diluted to a concentration of 12% by weight with ion exchanged water), and a 1 M aqueous sodium hydroxide solution are added in this order to control the pH of the raw material mixture to 8.0. Then, in order to fuse the aggregated particles, the temperature is increased to a coalescence temperature of 90° C. at a temperature rising rate of 1° C./min, and the coalescence of the aggregated particles is confirmed using an optical microscope, followed by cooling, to obtain a slurry including the toner particles.

Subsequently, the obtained slurry is filtered, ion exchanged water in the 10-fold amount relative to the toner solid content is added thereto, and the mixture is dispersed and stirred for 10 minutes. Filtration is repeated 5 times and the toner particles are washed. Further, after the filtration, 1,300 parts of ion exchanged water is added and the mixture is reslurried, warmed to 55° C., and adjusted to pH 5.0. Then, 6.5 parts of PAS-M-1 (40%-by-weight aqueous solution, methyl diallylamine hydrochloride polymer: manufactured by Nittobo Medical Co., Ltd.) is added, followed by stirring for 30 minutes. After cooling, the obtained slurry is filtered, ion exchanged water in the 5-fold amount relative to the toner solid content is added thereto and the toner particles are washed. Then, vacuum drying is performed to obtain toner particles 1 having a volume average particle diameter of 6.6 μm.

Thereafter, 100 parts of the obtained toner particles 1 are mixed with 2 parts of melamine-formaldehyde condensate (Epostar S from Japan Catalyst Co., Ltd., number average primary particle diameter of 200 nm) using a Henschel mixer (25 m/s for 10 minutes) to perform external addition to obtain a toner 1.

By the method above, the amine value of the extracted component in the aqueous layer of the toner 1 is measured and found to be 950, and the weight average molecular weight of the extracted component in the aqueous layer is measured and found to be 20,000.

In addition, the amount of the extracted component in the aqueous layer based on the total weight of the toner particles is 1.00% by weight.

Preparation of Developer 1

Into a ferrite carrier having a volume average particle diameter of 50 μm, coated with 1% by weight of a silicone resin (SR2411, manufactured by Dow Corning Toray Co., Ltd.), the toner 1 is weighed to a toner concentration of 5% by weight, and stirred and mixed for 30 minutes using a V blender to prepare a developer 1.

Using the obtained developer 1, evaluation of the positive charging amount and evaluation of the fogging shown below are performed. The results are shown in Table 1.

Evaluation Method

After the toner and the developer are placed in a modified DocuPrint 1100 CF manufactured by Fuji Xerox Co., Ltd. (modified such that a process speed or the like may be adjusted), evaluation of the positive charging amount and evaluation of the fogging are carried out by the following methods.

Evaluation of Positive Charging Amount

After carrying out printing on 100,000 A4 sheets using a chart having a printing rate of 50%, about 0.3 g to about 0.7 g of the developers are collected from the developing sleeve in a developing device. Under conditions of 25° C. and 55% RH, the toner charging amount is measured with a charging amount measuring device (TB200, manufactured by Toshiba Chemical Corp.) by a blow-off method.

Evaluation of Fogging

After carrying out printing on 100,000 A4 sheets using a chart having a printing rate of 50%, the number of the fogging toners present in the range of a diameter of 2 mm is counted with an optical microscope in the white background of the image after fixing. This measurement is carried out at 12 points on A4 paper and the number is averaged and evaluated by the following criteria. Further, the process speed is 1,000 mm/s and the conditions for the printing evaluation environment are 25° C. and 55% RH.

A: Number of fogging toners is 10 or less.

B: Number of fogging toners is from 11 to 30.

C: Number of fogging toners is from 31 to 60.

D: Number of fogging toners is 61 or more.

Preparation of Amorphous Polyester Resin 2

| | |
|---|---|
| Bisphenol A propylene oxide 2 moles adduct | 310 parts |
| Terephthalic acid | 116 parts |
| Succinic acid | 12.2 parts |
| Dodecyl succinic acid | 54.4 parts |
| $Ti(OC_4H_9)_4$ | 0.05 part |

In the same manner as for the preparation of the amorphous polyester resin 1 except that the composition above is used, an amorphous polyester resin 2 is obtained. The amorphous polyester resin 2 is amorphous, and has a glass transition temperature of 60° C., a softening temperature of 105° C., and an acid value of 14 mgKOH/g.

Preparation of Amorphous Polyester Resin Particle Dispersion 2

In the same manner as for the preparation of the amorphous polyester resin particle dispersion 1 except that the obtained amorphous polyester resin 2 is used, an amorphous polyester resin particle dispersion 2 is obtained. The volume average particle diameter of the obtained amorphous polyester resin particles is 135 nm and the solid concentration of the amorphous polyester resin particles is 32.0% by weight.

Comparative Example 1

Preparation of Toner Particles 2

| | |
|---|---|
| Amorphous Polyester Resin Particle Dispersion 2 | 490.6 parts |
| Release Agent Particle Dispersion | 87.9 parts |
| Colorant Particle Dispersion | 45.3 parts |
| Crystalline Polyester Resin Particle Dispersion 1 | 53.2 parts |
| Ion Exchanged Water | 610 parts |
| Anionic surfactant (NEOGEN R, manufactured by Dai-ichi Kogyo Seiyaku Co., Ltd.) | 2.25 parts |

By the same method as for the preparation of the toner particles 1 except for the above changes, toner particles 2 having a volume average particle diameter of 6.6 μm is obtained.

Thereafter, 100 parts of the obtained toner particles 2 are mixed with 2 parts of melamine-formaldehyde condensate (Epostar S from Japan Catalyst Co., Ltd., number average primary particle diameter of 200 nm) using a Henschel mixer (25 m/s for 10 minutes) to perform external addition to obtain a toner 2.

By the method above, the amine value of the extracted component in the aqueous layer of the toner 2 is measured and found to be 950, and the weight average molecular weight of the extracted component in the aqueous layer is measured and found to be 20,000.

In addition, the amount of the extracted component in the aqueous layer based on the total weight of the toner particles is 1.00% by weight.

Preparation of Developer 2

In the same manner as for the developer 1 except that the toner 2 is used, a developer 2 is prepared.

Using the obtained developer 2, evaluation of the positive charging amount and evaluation of the fogging shown below are performed. The results are shown in Table 1.

Examples 2 to 7 and Comparative Examples 2 and 3

In the same manner as in Example 1 except that PAS-M-1 which is a polymer amine is changed to those described in Table 1, the toners and the developers of Examples 2 to 7 and Comparative Examples 2 and 3 are each prepared and evaluated.

The evaluation results are shown in Table 1.

Comparative Example 4

In the same manner as in Example 1 described in JP-A-2009-244494, a negatively charged toner is prepared.

That is, it is prepared by the following manner.

Preparation of Toner Resin Solution

The following starting materials are mixed and then heated at 45° C. to prepare a resin solution.

| | |
|---|---|
| Polyester resin FC1565*1 | 17 parts by weight |
| Ester wax*2 | 1 part by weight |
| Nigrosine-based dye (charge-controlling agent)*3 | 1 part by weight |
| Carbon black (colorant)*4 | 1 part by weight |
| Methyl ethyl ketone | 80 parts by weight |

*1manufactured by Mitsubishi Rayon Co. Ltd., Tg of 64° C., Mn (number average molecular weight) of 5,000, Mw (weight average molecular weight) of 98,000, gel fraction (THF insoluble components) of 1.5% by weight, acid value of 6.1 mgKOH/g, ethylenically unsaturated bond not included

*2Unistar H476, manufactured by NOF Corporation

*3Bontron No. 4, manufactured by Orient Chemical Industries, Ltd.

*4Carbon black #260, manufactured by Mitsubishi Chemical Corporation 100 parts by weight of distilled water and 1 part by weight of a 1 N aqueous sodium hydroxide solution are mixed to prepare an aqueous medium, followed by heating at 45° C.

Next, 100 parts by weight of the resin solution and 100 parts by weight of the aqueous medium are blended therewith while keeping the temperature at 45° C. and are then stirred for 30 minutes at 16,000 rpm in a homogenizer DIAX900 (Heidolph Japan Ltd.) to prepare an emulsion.

A separable flask is charged with 1,600 parts by weight of the obtained emulsion. While blowing nitrogen into the gas phase, the organic solvent is removed therefrom through heating and stirring at 70° C. for 150 minutes to obtain a suspension. The volume average diameter of the resin microparticles in the suspension is 256 nm. Further, presence or absence of the precipitates in the suspension is confirmed, and as a result, there is no precipitate. Thereafter, the suspension is diluted with distilled water to obtain a solid concentration of the suspension of 10% by weight, to prepare 1,600 parts by weight of a suspension.

2.5 parts by weight of 0.2 N aluminum chloride is added to 100 parts by weight of the suspension, followed by high-speed mixing for 10 minutes in a homogenizer. The suspension is then heated at a liquid temperature of 45° C. while being stirred at 300 rpm using six flat turbine blades. Stirring is continued for 20 minutes. Thereafter, 2.5 parts by weight of a 0.2 N aqueous sodium hydroxide solution are added to the suspension, followed by warming to a liquid temperature of 90° C., while continuing the stirring for 5 hours until the toner mother particles becomes spherical, and then cooling. After cooling, 2.5 parts by weight of a 1 N aqueous hydrochloric acid solution are added to 100 parts by weight of the suspension, followed by stirring for 1 hour to fluidize the suspension, and then filtering and resuspending, to obtain a mother particle suspension.

Preparation of Negative Charge Control Resin Particle Suspension

The following raw materials are mixed to prepare a resin solution.

| | |
|---|---|
| Negative charge control resin FCA-1001NS*4 | 20 parts by weight |
| Methyl ethyl ketone | 80 parts by weight |

*4manufactured by Fujikura Kasei Co. Ltd., Tg of 59° C., Mw (weight average molecular weight) of 10,000, acid value of 21.1 mgKOH/g, styrene acrylic polymer 100 parts by weight of the prepared resin solution are blended with 100 parts by weight of distilled water, and the mixture is then stirred for 20 minutes at 16,000 rpm in a homogenizer DIAX900 (manufactured by Heidolph Japan Ltd.) to prepare an emulsion. A separable flask is charged with the obtained emulsion. The organic solvent is removed therefrom through heating and stirring at 60° C. for 90 minutes, while blowing nitrogen into the gas phase, to obtain a suspension of the negative charge control resin particles. The volume average particle diameter of the negative charge control resin particles in the suspension is 70 nm.

Polyallylamine PAA-25 (manufactured by Nittobo Medical Co., Ltd., molecular weight of about 25,000) is added to the toner mother particles suspension so as to be 1.0% by weight relative to the total weight of the toner mother particles, with stirring for 1 hour using a magnetic stirrer, followed by solid-liquid separation by performing filtration under reduced pressure. The obtained solid content is dispersed in water to 10% by weight of the solid contents. To this dispersion is added a negative charge control resin particle suspension so as to yield 3% by weight of the negative charge control resin particles relative to the mother particles. Dispersion is carried out for 3 minutes under application of ultrasounds to obtain a toner of Comparative Example 4.

In the same manner as in Example 1 except that the toner of Comparative Example 4 is used, a developer of Comparative Example 4 is prepared and evaluated. The evaluation results are shown in Table 1.

TABLE 1

| | Amorphous polyester resin | Polymer amines | Amine value of extracted components | Weight average molecular weight of extracted components | Amount of extracted components relative to toner mother particles | Positive charging amount | Fogging |
|---|---|---|---|---|---|---|---|
| Example 1 | (1) | PAS-M-1 | 950 | 20,000 | 1.00% by weight | +40 μC | A |
| Example 2 | (1) | SP-012 | 1,230 | 1,200 | 1.00% by weight | +20 μC | A |
| Example 3 | (1) | PAA-HCL-01 | 1,000 | 3,000 | 1.00% by weight | +25 μC | A |
| Example 4 | (1) | PAA-HCL-10L | 1,000 | 150,000 | 1.00% by weight | +25 μC | A |
| Example 5 | (1) | PAS-M-1 | 950 | 20,000 | 0.01% by weight | +10 μC | B |
| Example 6 | (1) | P-1000 | 650 | 70,000 | 1.00% by weight | +15 μC | B |
| Example 7 | (1) | P-1000 | 650 | 70,000 | 0.01% by weight | +10 μC | B |
| Comparative Example 1 | (2) | PAS-M-1 | 950 | 20,000 | 1.00% by weight | −20 μC | D |

TABLE 1-continued

| | Amorphous polyester resin | Polymer amines | Amine value of extracted components | Weight average molecular weight of extracted components | Amount of extracted components relative to toner mother particles | Positive charging amount | Fogging |
|---|---|---|---|---|---|---|---|
| Comparative Example 2 | (1) | SP-006 | 1,270 | 600 | 1.00% by weight | −5 μC | D |
| Comparative Example 3 | (1) | NK-100PM | 200 | 5,000 | 1.000% by weight | −25 μC | C |
| Comparative Example 4 | FC1565 | PAA-25 | 1,000 | 25,000 | 1.00% by weight | −43.5 μC | D |

Further, the polymer amines used in Examples 2 to 7 and Comparative Examples 2 to 4 are as follows.

P-1000: Polyethylenimine, EPOMIN P-1000, manufactured by Nippon Shokubai Co., Ltd., molecular weight of about 70,000

SP-012: Polyethylenimine, EPOMIN SP-012, manufactured by Nippon Shokubai Co., Ltd., molecular weight of about 1,200

SP-006: Polyethylenimine, EPOMIN SP-006, manufactured by Nippon Shokubai Co., Ltd., molecular weight of about 600

NK-100PM: Aminoethylated acrylic polymer, POLYMENT NK-100PM, manufactured by Nippon Shokubai Co., Ltd., molecular weight of 5,000

PAA-HCL-01: Allylamine hydrochloride polymer, 40% by weight aqueous solution, manufactured by Nittobo Medical Co., Ltd., weight average molecular weight of 1,600

PAA-HCL-10L: Allylamine hydrochloride polymer, 40% by weight aqueous solution, manufactured by Nittobo Medical Co., Ltd., weight average molecular weight of 20,000

PAA-25: Allylamine polymer, 10% by weight aqueous solution, manufactured by Nittobo Medical Co., Ltd., weight average molecular weight of 25,000

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A positively chargeable toner comprising:

toner mother particles containing a binder resin having an ethylenically unsaturated bond; and a water-soluble polymer compound having an amino group, the polymer compound having an amine value from 600 to 1,250 and a weight average molecular weight of from 1,000 to 200,000, wherein the polymer compound is adhered to a surface of the binder resin.

2. The positively chargeable toner according to claim 1, wherein an amount of the polymer compound is from 0.01% by weight to 10% by weight, based on the total weight of the toner.

3. The positively chargeable toner according to claim 1, wherein the polymer compound has a tertiary amino group and is present on at least a part of the surface of the toner mother particles.

4. The positively chargeable toner according to claim 2, wherein the polymer compound has a tertiary amino group and is present on at least a part of the surface of the toner mother particles.

5. The positively chargeable toner according to claim 1, wherein the binder resin has an acid value of from 5 mgKOH/g to 30 mgKOH/g.

6. The positively chargeable toner according to claim 2, wherein the binder resin has an acid value of from 5 mgKOH/g to 30 mgKOH/g.

7. The positively chargeable toner according to claim 3, wherein the binder resin has an acid value of from 5 mgKOH/g to 30 mgKOH/g.

8. The positively chargeable toner according to claim 4, wherein the binder resin has an acid value of from 5 mgKOH/g to 30 mgKOH/g.

9. An electrostatic charge image developer comprising:

the positively chargeable toner according to claim 1, and a carrier.

10. A toner cartridge that:

is detachable from an image forming apparatus including at least a developing unit that develops an electrostatic charge image to form a toner image; and contains the positively chargeable toner according to claim 1 as a toner to be supplied to the developing unit.

11. An image forming method comprising at least:

forming an electrostatic latent image on a surface of an image holding member;

developing the electrostatic latent image formed on the surface of the image holding member by a developer containing the positively chargeable toner according to claim 1 to form a toner image;

transferring the toner image onto a surface of a transfer member; and fixing the toner image transferred onto the surface of the transfer member.

12. An image forming apparatus comprising at least:

an image holding member;

an electrostatic charge image forming unit that forms an electrostatic charge image on a surface of the image holding member;

a developing unit that contains a developer containing the positively chargeable toner according to claim 1 and that develops the electrostatic charge image by the developer to form a toner image;

a transfer unit that transfers the toner image onto a surface of a transfer member; and a fixing unit that fixes the toner image transferred onto the surface of the transfer member.

13. The positively chargeable toner according to claim 1, wherein the polymer compound is selected from the group consisting of a polyethylenimine, a polyallylamine, an allylamine salt polymer, and a methyldiallylamine salt polymer.

14. The positively chargeable toner according to claim 1, wherein the binder resin has an acid value of from 7 mgKOH/g to 25 mgKOH/g.

15. The positively chargeable toner according to claim 1, wherein the polymer compound is reacted with the surface of the binder resin.

* * * * *